United States Patent [19]

Grover, Jr. et al.

[11] 4,262,842

[45] Apr. 21, 1981

[54] HOT WATER TIMER

[75] Inventors: Thomas B. Grover, Jr., 11/70 Vance Jackson, San Antonio, Tex. 78230; Le Moey Wiebush; David G. Anderson, both of San Antonio, Tex.

[73] Assignee: Thomas B. Grover, San Antonio, Tex.

[21] Appl. No.: 65,513

[22] Filed: Aug. 10, 1979

[51] Int. Cl.[3] ..... G07C 3/10

[52] U.S. Cl. ..... 235/92 T; 235/92 PD; 368/10

[58] Field of Search ..... 235/92 T, 92 PD; 340/371, 309.4, 309.1; 368/10, 1, 109; 137/552.7

[56] References Cited

U.S. PATENT DOCUMENTS

| | | | |
|---|---|---|---|
| 3,783,364 | 1/1974 | Gallanis et al. | 368/10 |
| 4,075,829 | 2/1978 | Goff | 235/92 T |
| 4,180,724 | 12/1979 | Councilman et al. | 235/92 T |

*Primary Examiner*—Joseph M. Thesz

*Attorney, Agent, or Firm*—Gunn & Lee

[57] ABSTRACT

A timer for monitoring the use of hot water in the home to conserve energy is shown. The entire timer apparatus is enclosed inside the hot water control knob so that when the control knob is rotated to turn ON the hot water, the timer is activated. After predetermined time intervals, various visual and audio alarms are given, the alarms thus encouraging the conservation of energy by using less hot water. Also, the timer monitors the number of times the hot water has been used during a given period of time, such as a month or year. The timer, in addition to its primary energy saving function, is ideally suited for use as the hot water control knob of a bathroom shower.

15 Claims, 14 Drawing Figures

HOT WATER TIMER

BACKGROUND OF THE INVENTION

In the typical household, one of the major users of energy is the hot water heater. According to the United States Department of Energy, approximately 14.5% of the total energy consumed in the average home is due to the heating of hot water. With today's necessary emphasis on energy conservation, by using less hot water, most families would save a significant amount on their utility bills. While various methods or schemes have been devised in the past to use less hot water, to be truly effective, it requires a conscious effort on behalf of each of the individual members of the household to save any substantial amount of their utility bills, including hot water consumption. The present invention is designed to make the individual members of the household more conscious of the amount of hot water they consume daily, particularly when taking a shower.

The typical time that a person normally spends in the shower is approximately five to six minutes. A nine minute shower is normally considered a fairly long shower, but on the other hand, a three minute shower would be a very short time interval for the taking of a shower. Since the taking of a shower is the most popular way of bathing, by decreasing the amount of time individual members of the household are in the shower, or at least making them conscious of the time, discretionary discipline encouraged and assisted by the hot water timer could substantially reduce the consumption of hot water, and therefore the energy necessary for the heating and maintaining temperature of hot water in the home.

SUMMARY OF THE INVENTION

The present invention is designed to make a person conscious of the number of times they turn hot water ON and OFF, and the length of time the hot water has been ON. While the present invention is designed as a hot water control knob for a shower, it could be used at many other locations in the home or in commercial buildings where the hot water is turned ON and OFF.

It is an object of the present invention to have a self-contained hot water control knob that furnishes audio and visual indications to a person as to how long the hot water has been ON.

It is a further object of the present invention to have a hot water control knob that has a self-contained electronic control unit with a visual display for indicating the length of time the hot water has been ON, the number of times the hot water has been turned ON during various time intervals plus giving other visual or audio indications to remind the members of the household that they are consuming energy by their use of hot water. The electronic control unit of the timer is designed so that it could be essentially one integrated circuit chip that is battery powered and controls external visual and audio warning signals for the individual user. The warning signals could be a sonic alarm, sequentially timed colored lights, or liquid crystal displays (LCD) indicating minutes or other information. The LCD could indicate the number of times the shower has been used during various periods of time, such as months or a year. A typical activation switch may include a mercury tilt switch that turns the timer circuitry ON at the time the hot water control knob is turned ON. By using an integrated circuit chip, the entire control circuitry and warning indicators can be contained within the hot water control knob. The visual displays will be located on the surface of the hot water control knob with appropriate electrical connections to the integrated circuit chip located internal to the control knob. The control knob would be appropriately sealed to prevent moisture from reaching the control circuit.

DESCRIPTION OF THE PREFERRED EMBODIMENT

In today's society, one of the major costs of energy in the home is the heating of hot water. By decreasing the consumption of hot water, the energy bill for the home can be substantially decreased. Also in the typical home, the most common method of bathing is by a shower. The present invention is designed as a replacement of the standard hot water knob in the typical home or apartment, or to be used in new installations. The hot water knob has visual and audio indications to continuously remind the users that they are consuming hot water and to keep them conscious of the energy shortage. Also the present inventions monitors the number of times the hot water is used over a time interval.

Figure 2:
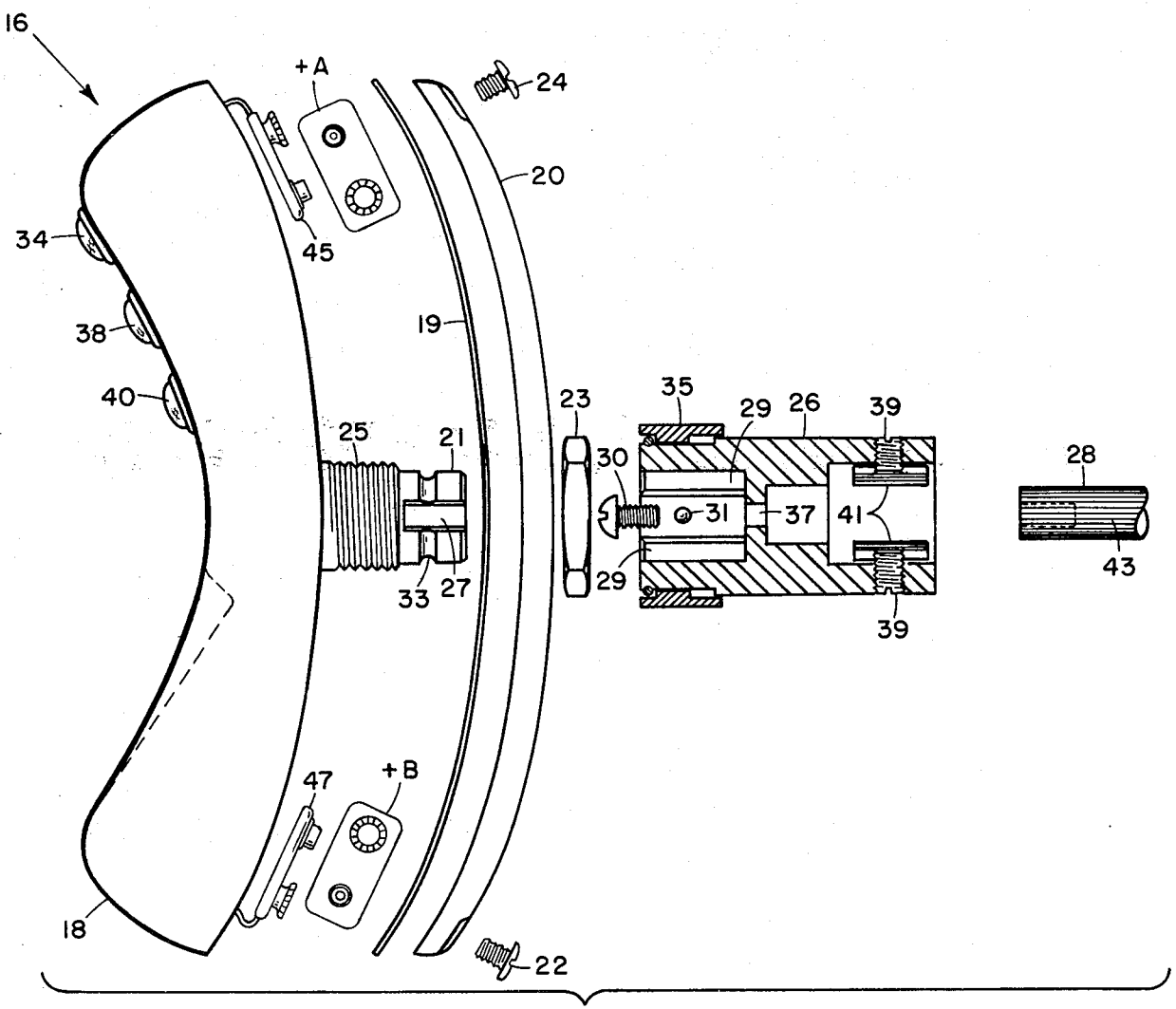
FIG. 2 is a right side exploded view of FIG. 1.
Figure 1:
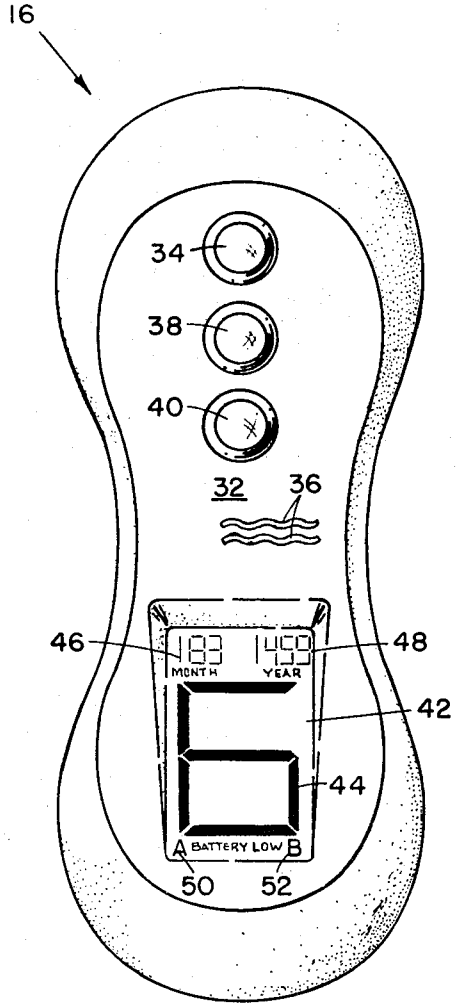
FIG. 1 is a front elevated view of a hot water control knob embodying the present invention.

Referring generally to FIGS. 1 and 2 in combination, there is shown a hot water control knob represented generally by reference numeral 16. A front half 18 and rear half 20 of the control knob 16 are connected together by screws 22 and 24 by threads (not shown) in front half 18. Gasket 19 is located between front half 18 and rear half 20 to prevent leakage of moisture control knob 16. Rear half 20 has an opening (not shown) for receiving mounting shank 21 therethrough. Nut 23 holds rear half against front half 18 with gasket 19 therebetween by threadably connecting to threads 25 of mounting shank 21.

Adapter 26 connects to mounting shank 21 which is integrally formed with front half 18. Slots 27 of mounting shank 21 are constructed to receive raised portions 29 of adapter 26 therein. Spring loaded ball pin 31 may be releasably received in groove 33 of mounting shank 21. By turning sleeve 35, the spring loaded ball pin 31 is secured in groove 33.

Previously, adapter 26 would have been connected to a standard shank 28 that controls a hot water valve (not shown). Bolt 30 extends through opening 37 to threadably connect to shank 28. Set screws 39 close jaws 41 tightly against external ridges 43 of shank 28 to insure simultaneous rotation of both.

By threadably connecting the front half 18 to the rear half 20 of the hot water control knob 16 by means of screws 22 and 24, the hot water control knob 16 will appear from the front thereof as shown in FIG. 1. In exploded FIG. 2, only the batteries +A and +B, and their connectors 45 and 47 are shown of the electrical control circuit. On the front face 32 of the hot water control knob 16, there are visual indicators that indicate the time during which hot water has been consumed, which is directly proportional to the amount of hot water consumed and energy used. The visual indicators are activated by control circuitry contained internally within the hot water control knob as will be explained in more detail subsequently.

Once the hot water is turned ON by rotation of the hot water control knob 16, after the expiration of three minutes green light 34 will light up. Simultaneously with the lighting of green light 34, a short duration sonic alarm will be given through sealed speaker 36. After the expiration of six minutes, yellow light 38 will light up and again the sealed speaker 36 will give a short duration sonic alarm. After the expiration of nine minutes, red light 40 will light up and again the sealed speaker 36 will give a short duration sonic alarm. Previously upon the lighting of yellow light 38, green light 34 will go OFF. Likewise upon the lighting of red light 40, yellow light 38 will go OFF. However, red light 40 will remain lit for the remaining duration of the shower. All of the lights 34, 38 and 40 may flash during the previously described periods when they are to be turned ON.

Located on the lower portion of front half 18 of the control knob 16 is a liquid crystal display designated generally by reference numeral 42. The liquid crystal display (hereinafter abbreviated LCD) 42 has three separate components for indicating Arabic numerals and two battery low indicators. The largest of the Arabic numerals on the LCD 42 is the minute indicator 44. The minute indicator 44 counts from 1 through 9 depending upon the number of minutes the shower has been turned on. The month indicator 46 tells the number of showers that have been taken per month and the year indicator 48 tells the number of showers that have been taken per year. Also, the LCD 42 has an indication that will tell if either of the two batteries +A or +B are low. The LCD 42 will indicate the battery low condition by either +A indicator 50 or +B indicator 52. Operation of the electronic control circuitry for operating the lights 34, 38 and 40, sealed speaker 36, LCD 42, minute indicator 44, month indicator 46, year indicator 48 and battery low indicators 50 and 52 will be explained in more detail subsequently.

Figure 3:
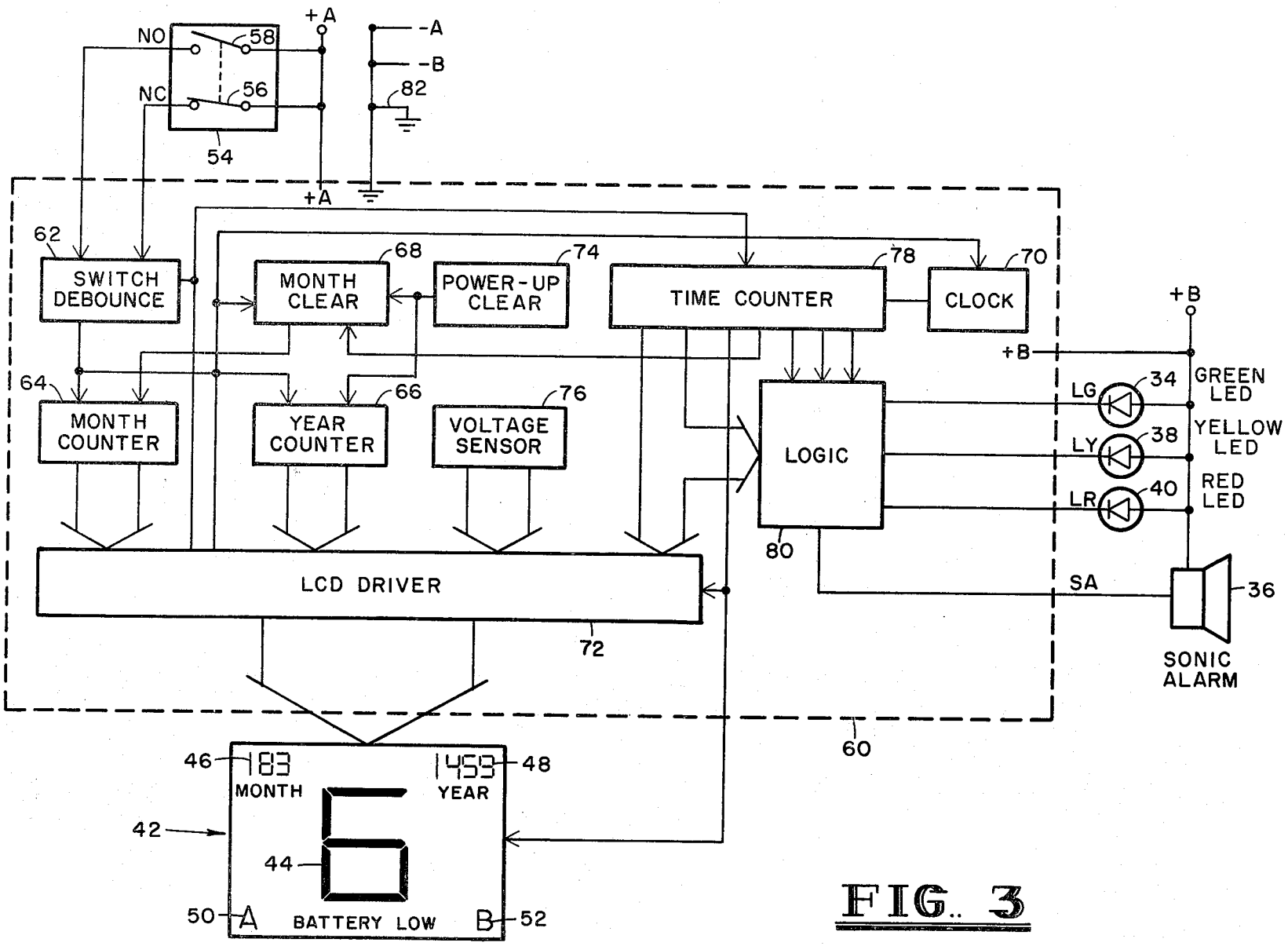
FIG. 3 is a functional block diagram of the electronic control portion of the present invention.

Referring now to FIG. 3 of the drawings, there is shown a functional block diagram of the control circuitry of this preferred embodiment as will be contained inside of the control knob 16. Items that have previously been referred to will have the same numeral designation as previously assigned. When the control knob 16 is turned, mercury tilt switch 54 is operated so that normally closed switch 56 is opened, and normally opened switch 58 is closed. The mercury tilt switch 54 may be mechanically set so that only a few degrees of rotation of the control knob 16 will activate the mercury tilt switch 54. Upon closing of the normally opened contact 58 of mercury tilt switch 54, battery voltage of +A is connected to the integrated circuit chip 60 commonly referred to as "LSI" for "large scale integrating".

Inside of LSI chip 60 both the normally opened and normally closed contacts 58 and 56, respectively, connect to switch debounce 62. The switch debounce 62 prevents random spikes from reaching the control circuit and acts in a manner similar to a switch latch. From the switch debounce 62, a signal is fed to the month counter 64, year counter 66, month clear 68, clock 70 and LCD driver 72. The month counter 64 indicates the number of times the hot water for the shower has been turned ON by hot water control knob 16 per month. At the end of each month, the month counter 64 may be cleared by month clear 68. Also at the time power is turned ON to the control system, power up clear 74 will clear the month counter 64 via month clear 68 and the year counter 66. The power up clear 74 is necessary when the battery +A is connected to the entire LSI chip 60. Normally the power up clear 74 will only occur once a year at the time the year counter 66 is being reset, or the batteries +A or +B are being replaced. The circuitry is designed so that if batteries +A and +B are standard 9 volt transistor batteries, they should last approximately one year.

Each time the mercury tilt switch 54 is turned ON, the month counter 64 and year counter 66 will count one count via switch debounce 62. Outputs from the month counter 64 and year counter 66 feed through LCD driver 72 to LCD 42 to be displayed as month indicator 46 or year indicator 48. The LCD driver 42 takes a binary coded decimal output from the month counter 64 and year counter 66, decodes it in such a manner to drive the appropriate Arabic numeral indication for the month indicator 46 and year indicator 48 of the LCD 42. There is no current during operation of the month clear 68 as will be explained in more detail subsequently.

A voltage sensor 76 continually monitors the battery voltages of +A and +B to determine if their voltage level is sufficient to perform their respective functions. Assume that +A and +B are standard 9 volt transistor batteries. Normally the circuitry would continue to operate if the voltage dropped to approximately 7 volts DC. Therefore, the voltage sensor 76 would be set for approximately 7½ volts DC. If either battery +A or +B drops below the set 7½ volts level, LCD driver 72 would activate the respective +A or +B indicator 50 or 52, respectively. Thereafter, each time the shower is used, the +A or +B indicators 50 or 52 would light up until the voltage of the respective battery dropped to such a point that the circuitry would no longer function. Generally, the +A battery is used to power the LSI chip 60, while the +B battery is used to power the lights 34, 38 and 40, and sealed speaker 36 of the sonic alarm. The +A or +B battery can be replaced by removing the control knob 16 by rotating sleeve 35 and by removing screws 22 and 24. Each time the +A battery is disconnected and reconnected to the system, upon turning the control knob 16, the power up clear 74 will clear the month counter 64 and year counter 66.

Upon the clock 70 receiving a signal from switch debounce 62, the clock 70 is turned ON. The clock 70 is a free running astable multivibrator using an RC circuit. While many different types of clocks may be used, in this preferred embodiment, the clock 72 has a frequency output of 1.12 MHz with a plus or minus 10% tolerance. The output from the clock is fed into time counter 78. The time counter 78 has various frequency outputs that are fed to the logic 80, LCD driver 72 and month clear 68. Since LCD's need approximately 30–100 Hz to properly operate, in this preferred embodiment, time counter 78 provides a 68 Hz signal to LCD driver 72.

Through logic 80, time counter 78 also provides a low frequency signal that will cause the respective lights 34, 38 or 40 to flash during the respective periods they would normally be ON. Also, another frequency from the time counter 78 provided through logic 80 operates the sonic alarm 36. Another frequency signal will be used in the month clear 68 as will be described in more detail subsequently.

Referring now to the LCD 42 as generally shown in FIG. 3, the LCD 42 is a custom made liquid crystal display that will meet the particular requirements of the present invention. The month indicator 46 is a 2½ digit display that can display any numeral from 0 to 199. The most significant bit of one is either ON or OFF as the numeral 1. The other numerals may count from 0 through 9.

Concerning the year indicator 48, it is a 3½ digit display again with the most significant digit being either ON or OFF as the numeral 1. The year indicator can count from 0 to 1999. If the maximum digit of either the month indicator 46 or year indicator 48 is exceeded, the respective indicator will recycle to 0 and start over. The terms "month" and "year" may be engraved on the face of the LCD 42 or the adjacent surface of face 32.

Concerning the minute indicator 44, it will count from 0 through 9 minutes, which will closely approximate the number of minutes the shower has been turned ON by control knob 16. If the shower remains ON more than nine minutes, the minute indicator 44 will simply recycle and begin counting again, but will have no effect on the red light 40 which will continue to flash.

Also on the face of the LCD 42 may be engraved the terms "Battery Low", as well as the letters "A" and "B". The terms "Battery Low" may be on the adjacent surface of face 32. When the voltage sensor 76 senses that either battery +A or +B is low, the respective +A indicator 50 or +B indicator 52 will light up. In the presently designed system, typical 9 volt batteries for +A and +B should last approximately one year. To prevent grounding problems with the control circuitry, a ground 82 is provided between the LSI chip 60 and remaining portions of the circuit. The ground 82 will function as a chassis and battery ground, but will not be an earth ground.

Concerning the mercury tilt switch 54, it may be mechanically adjusted so that only a few degrees of turning of the control knob 16 will activate the mercury tilt switch 54. There will be a small amount of hysteresis between the ON and OFF operation of the mercury tilt switch 54 which may be further increased or decreased by the use of either U-shaped tubes or tubes having a flat middle portion to desensitize the mercury tilt switch 54. The mechanical adjustment of the mercury tilt switch 54 depends upon the characteristics necessary for the operation of the particular hot water valve (not shown) as controlled through shank 28.

Figure 4:
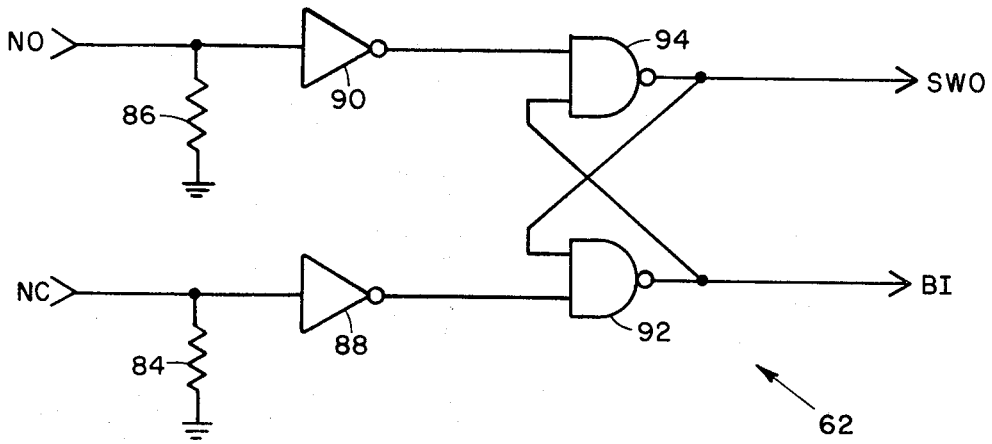
FIG. 4 is a schematic view of the switch debounce shown in FIG. 3.

The hysteresis of the mercury tilt switch 54 also ties in with the time for operation of the switch debounce 62 because a finite period of time is necessary to change positions of the normally closed contact 56 and normally opened contact 58. Referring to FIG. 4, the switch debounce 62 is shown in detail. The +A voltage is fed through normally opened contact 58 (NO) and normally closed contact 56 (NC) to the switch debounce as shown in FIG. 4. The switch debounce utilizes a pair of resistors 84 and 86, inverters 88 and 90, and NAND gates 92 and 94, which are arranged in a standard latch configuration commonly referred to as an "RS" latch. By use of the latch configuration as shown in FIG. 4, the +A voltage received through the NC contact will not allow a change of state in the outputs designated BI or SWO until the NO contact has closed.

Figure 5:
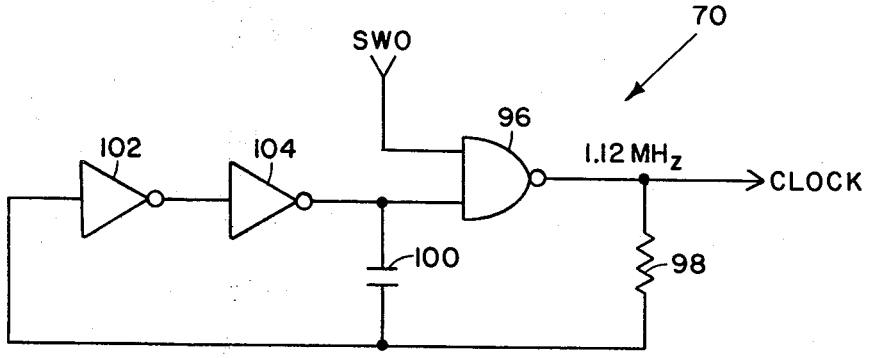
FIG. 5 is a schematic diagram of the clock shown in FIG. 3.

Upon receiving the SWO signal from the switch debounce 62 by the clock 70 as shown in FIG. 5, the clock 70 is activated. The input signal of SWO to the NAND gate 96 causes an output that is fed back through resistor 98 and capacitor 100 to the other input of the NAND gate 96, as well as a loop consisting of inverters 102 and 104. The configuration for the clock as shown in FIG. 5 is a typical free running astable multivibrator whose components may be purchased off the shelf.

Figure 6:
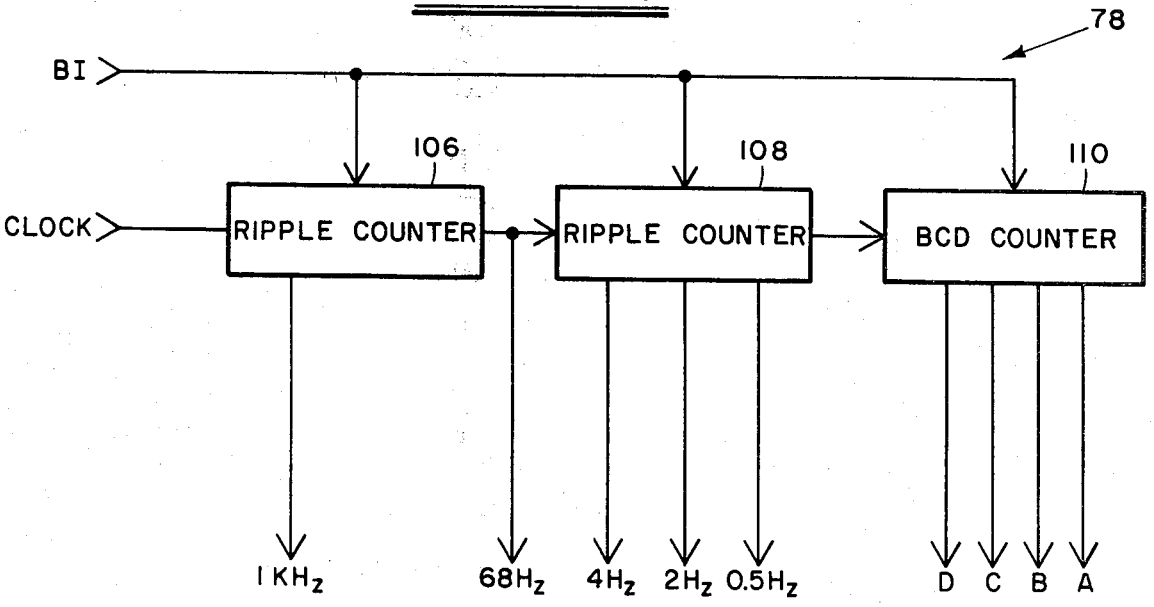
FIG. 6 is a schematic diagram of the time counter shown in FIG. 3.

The clock output from FIG. 5 is fed into time counter 78 as shown in detail in FIG. 6. The first stage of the time counter 78 is a ripple counter 106, which in turn feeds into ripple counter 108. Ripple counters 106 and 108, if they were not being made as part of an integrated circuit chip, could be purchased as discrete components with a component number for National Semiconductor being CD4020. From ripple counter 106, a 1 kHz output is provided. Also, a 68 Hz output is provided which is in turn fed into ripple counter 108. From ripple counter 108, outputs of 4 Hz, 2 Hz and 0.5 Hz are also provided. The output from ripple counter 108, which is the clock frequency of 1.12 MHz divided by $2^{26}$, is fed into BCD counter 110. In BCD counter 110, the signal is converted to a binary coded decimal output. Typical BCD counters can be purchased from National Semiconductor under Part No. CD4029. The binary coded decimal outputs are designated by the letters A, B, C and D, with the letter A being the least significant bit, and the letter D being the most significant bit.

Figure 7:
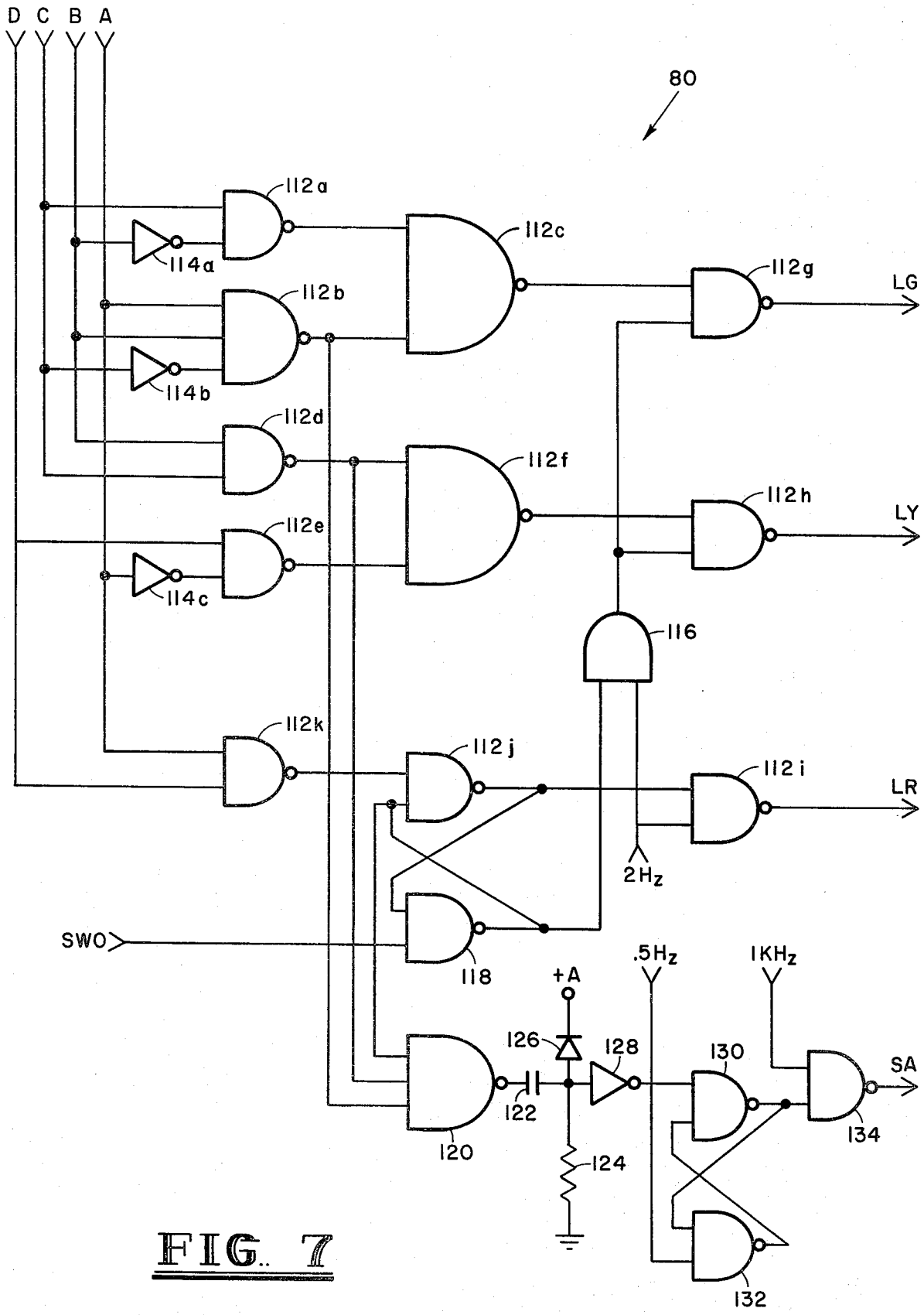
FIG. 7 is a schematic diagram of the logic shown in FIG. 3.

Referring now to FIG. 7, the circuitry for logic 80 is shown. From time counter 78 as is described in detail in FIG. 6, inputs into logic 80 include bits A, B, C and D, plus 0.5 Hz, 2 Hz and 1 kHz. In the binary coded output of A, B, C and D, the least significant of A corresponds to 1 minute, B—2 minutes, C—4 minutes, and D—8 minutes. For operation of the green light 34, yellow light 38 and red light 40, the binary coded decimal input and logic 80 after processing through the logic gives output signals of LG, LY and LR. Standard logic of NAND gates 112, inverters 114 and AND gate 116 are used. Without explaining in detail, the truth table for logic 80 is shown in FIG. 7, upon three minutes passing as indicated by the binary coded decimal input A, B, C and D, NAND gate **112*g* will have an output signal of LG which will be pulsed every half second by AND gate 116 which receives a 2 Hz signal input thereto. Therefore, from 3–6 minutes during the operation of the shower, the green light 34** will be flashed on and off every half second.

After the expiration of 6 seconds as indicated by the binary coded decimal input A, B, C and D, the flashing of the LG output will be terminated thereby stopping the flashing of the green light 34 and an output will be given through NAND gate 112*h* to give the output signal of LY which will again be flashed every half second by the 2 Hz signal input through AND gate 116. This will continue until the expiration of 9 minutes, at which time the yellow light 38 will be turned off by removing the signal LY and in turn NAND gate 112*i* will have an output of LR. The output LR which controls the red light 40 will then begin to flash every half second as controlled by the 2 Hz input. After the expiration of 9 minutes regardless of how long the shower remains on as controlled by the control knob 16, a latch formed by NAND gate 112*j* and 118 will maintain the output LR as long as the input signal SWO is continually received from the switch debounce 62.

An additional feature of the logic 80 is that the sealed speaker 36 gives a sonic alarm as controlled by the SA output each time the lights 34, 38 or 40 change conditions as controlled by LG, LY or LR, respectively. The sonic alarm is controlled by NAND gate 120, the output of which is connected to +A through a network of capacitor 122, resistor 124 and diode 126 to give a spike voltage output. The spike voltage is fed through inverter 128 into the latch formed by NAND gates 130 and 132, a sonic alarm SA output is given from NAND gate 134. The 1 kHz input signal into NAND gate 134 gives the sonic control necessary for an audio output. The 0.5 Hz input maintains the sonic output for approximately 2 seconds each time the lights 34, 38 or 40 change state by holding the latch formed by NAND gates 130 and 132 ON approximately two seconds. This gives an audio warning as well as the visual warnings at the 3, 6 and 9 minute intervals.

Figure 8:
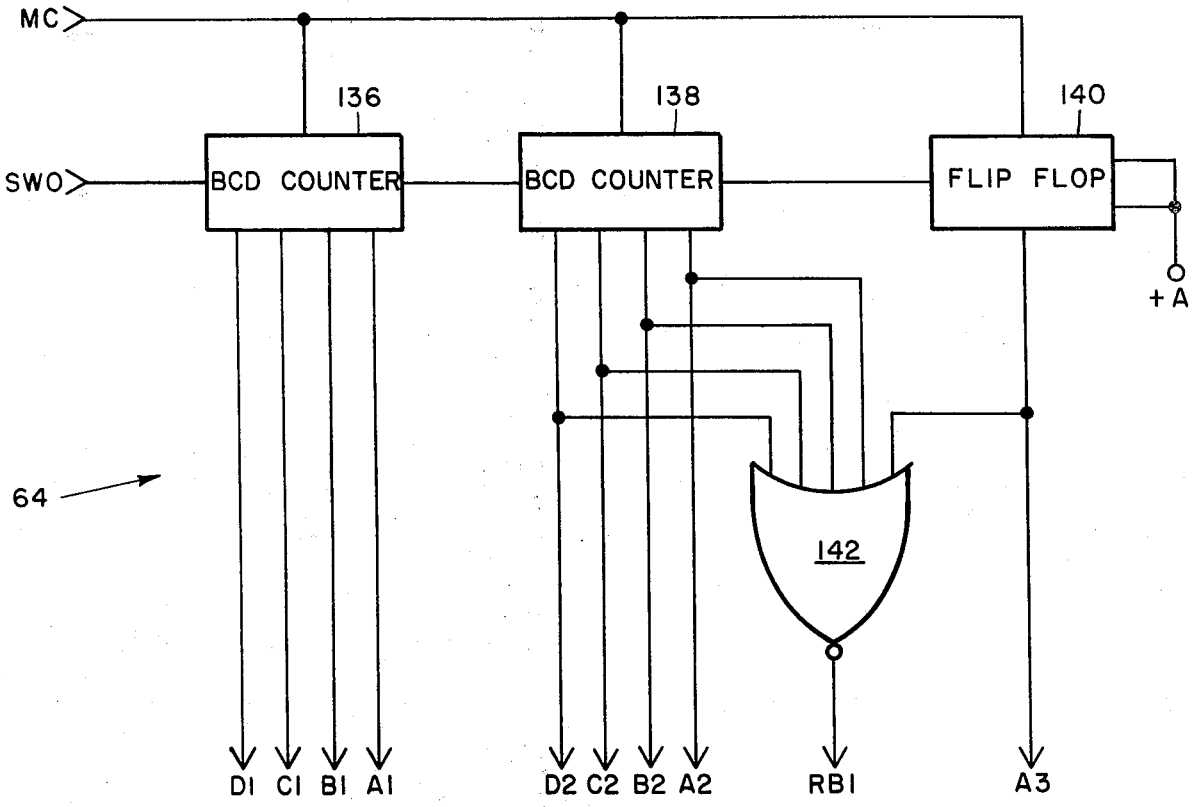
FIG. 8 is a schematic diagram of the month counter shown in FIG. 3.

Referring now to FIG. 8, the month counter 64 will be explained in detail. The month counter 64 may count up to a maximum 199 separate showers, the count being controlled by the number of times the control knob 16 is turned ON. The month counter 64 includes two BCD counters 136 and 138, both of which have binary coded decimal outputs that feed into the LCD driver 72. The count for the BCD counters 136 and 138 is controlled by the output SWO from switch debounce 62. The outputs A1, B1, C1 and D1 of BCD counter 136 are for the least significant digit of the month indicator 46 as shown in FIG. 3. The outputs A2, B2, C2 and D2 of BCD counter 138 form the second digit in the month indicator 46. The flip-flop 140 has an output A3, which controls the most significant digit of the month indicator 46. The most significant digit simply turns ON or OFF a 1 as contained in the LCD 42. All of the outputs from BCD counter 138 and flipflop 140 feed into NOR gate 142, which has an RB1 output. The RB1 output is for a blanking circuit so that if the second and third digits controlled by BCD counter 138 or flipflop 140 are not counting, they are turned off. In other words, a 0 would not appear on the second digit in the month indicator 46, nor would there be a most significant digit unless the count has reached those figures. Since the output from flip-flop 140 is either a 1, or is not ON, it is commonly referred to as a "half digit". Therefore, the month indicator 46 is basically a 2½ digit indicator.

Figure 9:
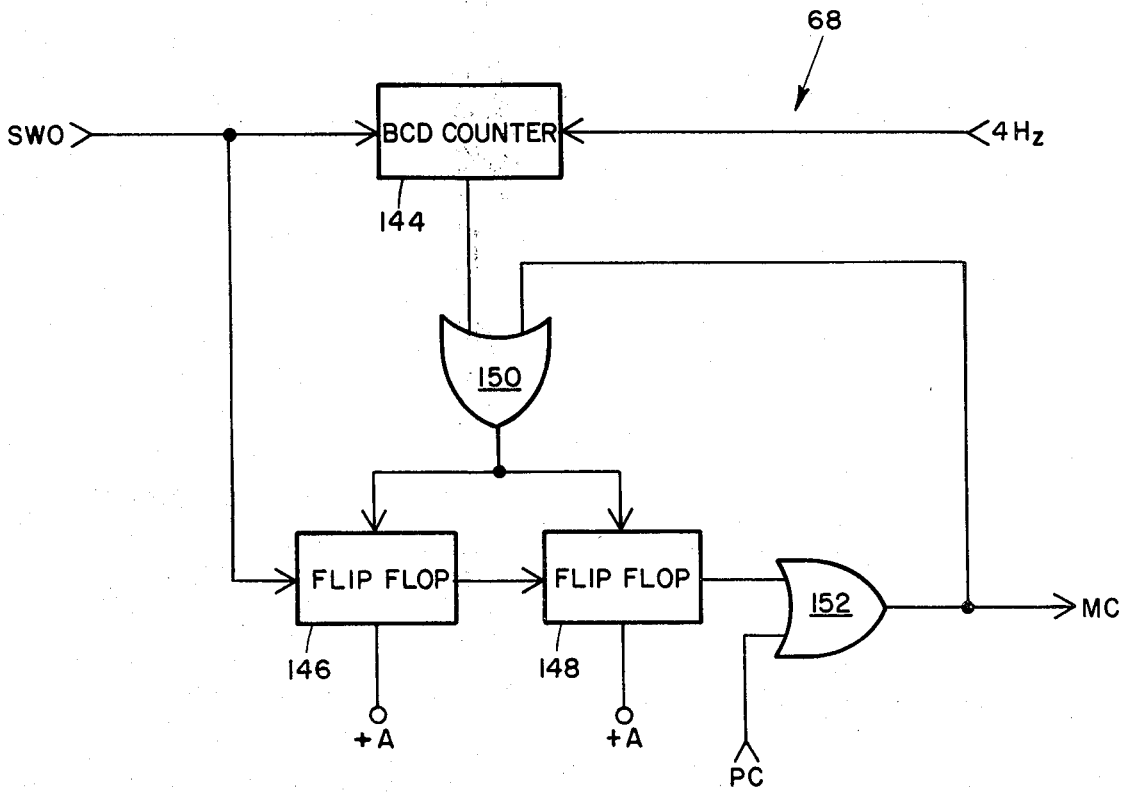
FIG. 9 is a schematic diagram of the month clear shown in FIG. 3.

To reset the month counter 64, an input MC from the month clear 68 may be used to clear BCD counters 136 and 138 and flip-flop 140. Once the MC input has been received, the month indicator 46 via the month counter 64 is reset to 0. Referring to FIG. 9, the month clear 68 is shown in detail. The input SWO from the switch debounce 62 feeds into BCD counter 144 which also receives a 4 Hz input from time counter 78. Also, the input SWO feeds into flip-flop 146, the output of which is connected to flip-flop 148. By turning the control knob 16 ON and OFF within 2½ seconds, the flip-flops 146 and 148 are allowed to count up through OR gate 50. Since most showers would take more than 2½ seconds, by turning the control knob 16 ON and OFF three times, each time the hot water being turned ON less than 2½ seconds, the flip-flops 146 and 148 will count up to 3, thereby giving an MC output through OR gate 152. This will reset the month indicator 46 in the manner as has been previously explained.

Also, an input of PC from the power up clear 74 may be fed through OR gate 152 to give the output MC for clearing the month counter 64. The input PC in FIG. 9 for the month clear 68 is generated by the power up clear 74 shown in FIG. 3 and in detail in FIG. 11 as will be explained in more detail subsequently.

Figure 10:
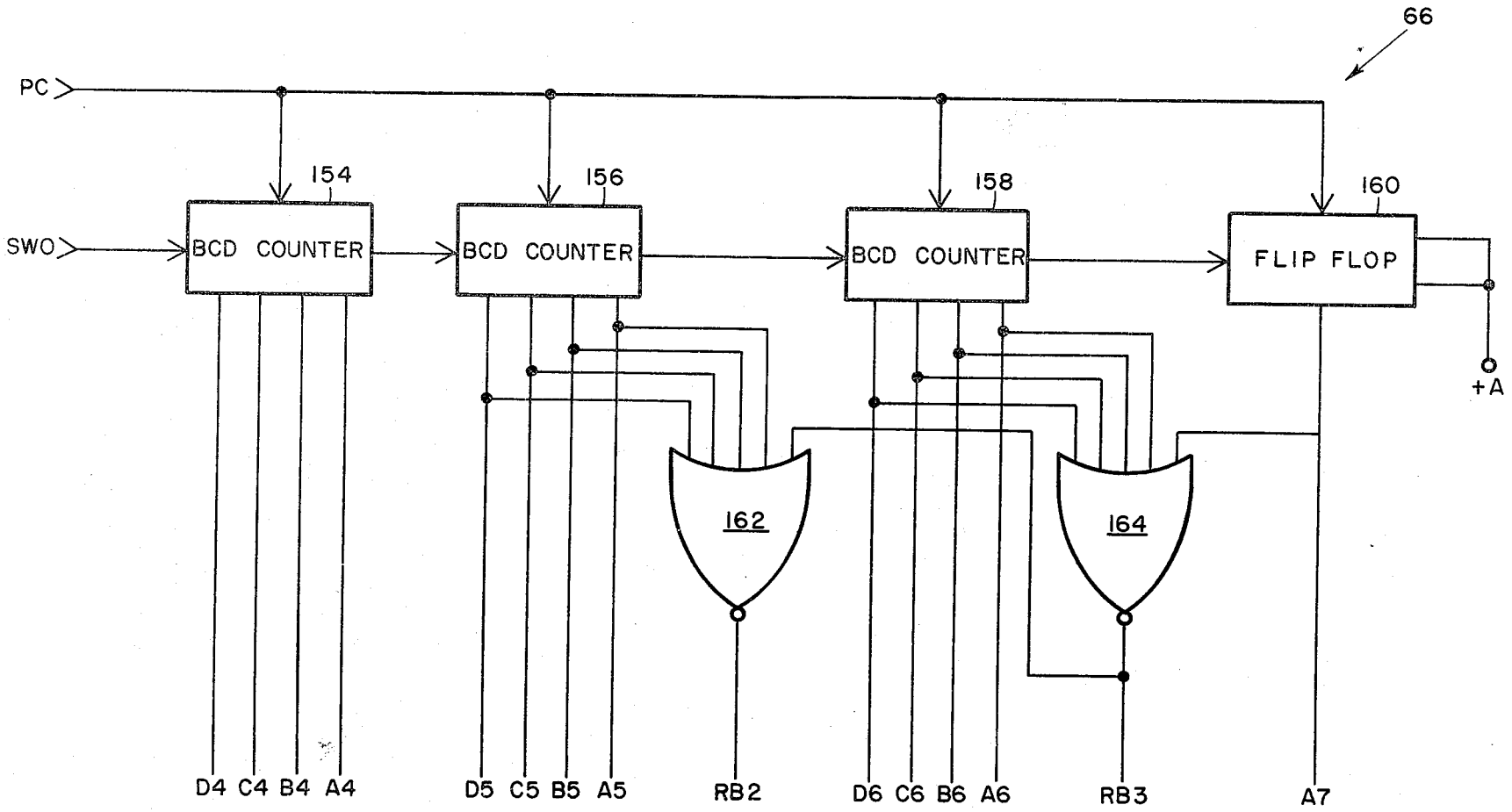
FIG. 10 is a schematic diagram of the year counter shown in FIG. 3.

Referring now to FIG. 10, the power up clear 74 has the input PC feeding into the year counter 66 for reset function. Also, the switch debounce 62 has the input SWO feeding into BCD counter 154, which has outputs A4, B4, C4 and D4 for the least significant digit of the year indicator 48. The output for BCD counter 154 feeds into BCD counter 156, which has outputs of A5, B5, C5 and D5 for the next most significant digit of the year indicator 48. Likewise, the output for BCD counter 156 feeds into BCD counter 158 to form the third most significant digit by inputs A6, B6, C6 and D6 for the year indicator 48. The output from BCD counter 158 in turn feeds flip-flop 160 which has the most significant digit output for year indicator 48 as controlled by output A7. NOR gates 162 and 164 provide blanking as indicated by outputs RB2 and RB3 to prevent higher digits for the year indicator 48 from being turned ON unless there is a count. The purpose of the blanking from NOR gates 162 and 164 is to prevent zeros (if they are the most significant digit) in year indicator 48 from showing. Only positive counting digits in year indicator 48 should be shown.

Figure 11:
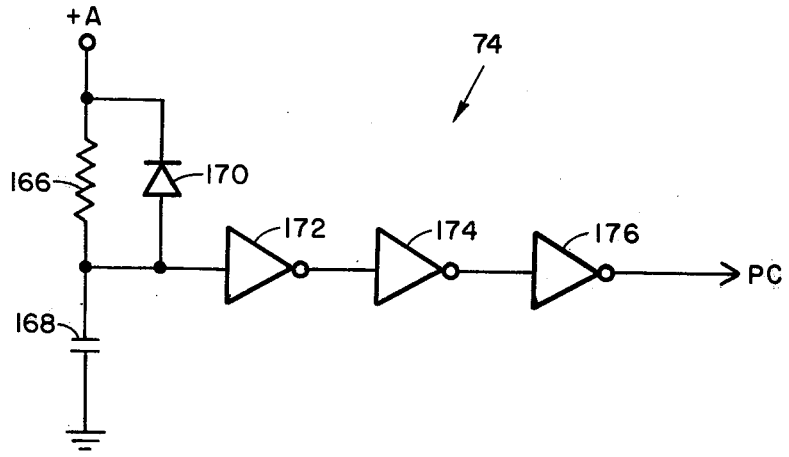
FIG. 11 is a schematic diagram of the power up clear shown in FIG. 3.

Referring now to FIG. 11 for the power up clear 74, the battery voltage of +A is connected across an RC network formed by resistor 166 and capacitor 168 with a feedback diode 170. The voltage developed across the capacitor 160 is fed through three inverters, 172, 174 and 176 to give a sharp rise time for PC output that is used to clear the month counter 64 and year counter 66. The diode 170 provides protection for the circuit during the switching functions. Each time the battery +A is disconnected and reconnected, a PC output is given that will clear both the month indicator 46 and year indicator 48. By present design of the circuit, this should occur approximately once per year.

Figure 12:
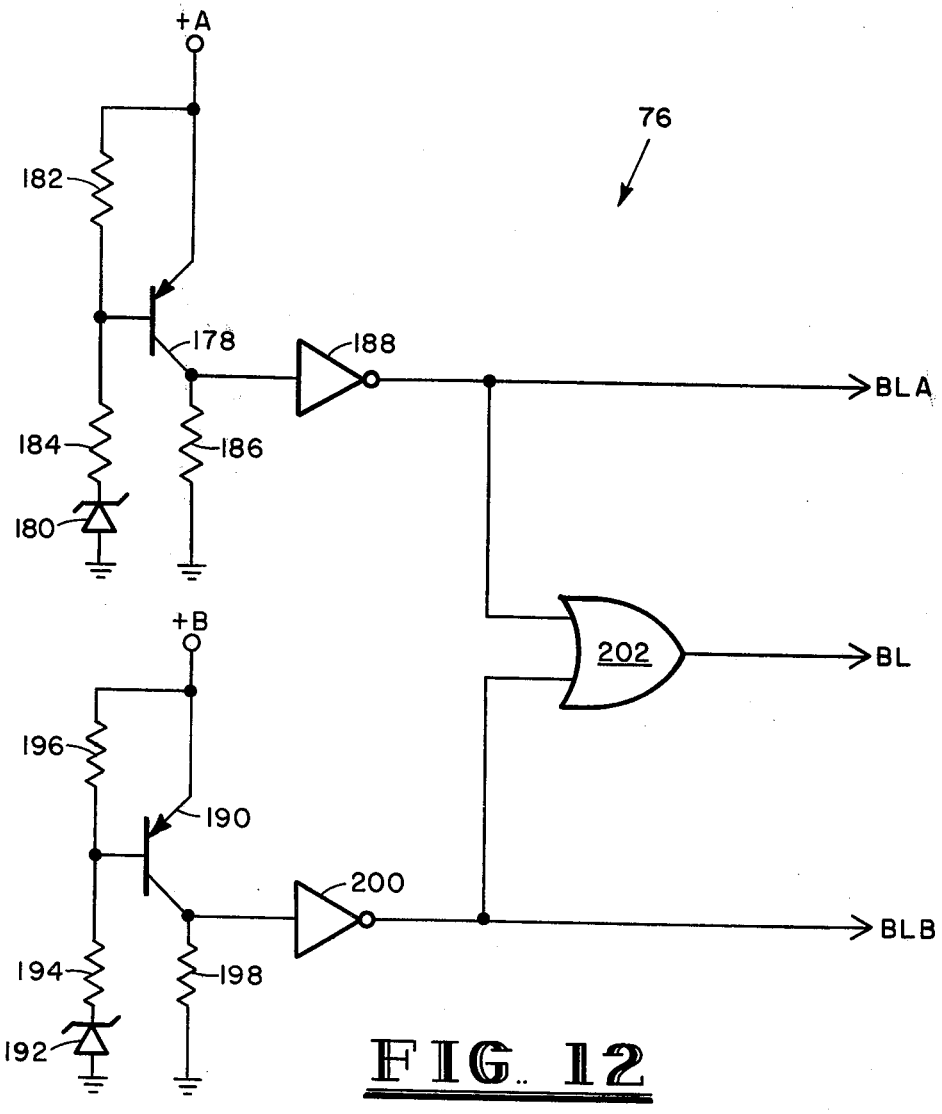
FIG. 12 is a schematic diagram of the voltage sensor shown in FIG. 3.

Referring now to FIG. 12, the voltage sensor 76 as shown in FIG. 3 is given in detail. Battery voltage +A is connected across PNP transistor 178 which has a base biasing voltage controlled by zener diode 180 and resistors 182, 184 and 186. By proper selection of the values for the zener diode 180 and resistors 182, 184 and 186, the switching point for the PNP transistor 178 can be set for any particular desired voltage with the present case being set for switching of approximately 7–7½ volts DC. The output from PNP transistor 178 as developed across resistor 186 feeds through inverter 188 to give the battery low indication BLA to indicate that battery +A is low.

Likewise, battery +B is connected across transistor 190 again controlled by zener diode 192, resistors 194, 196 and 198, the same as previously described for battery +A. The output from transistor 190 feeds through inverter 200 to give a battery low indication BLA, which indicates that battery +B is low. Also, if a separate light is to be controlled to indicate "battery low", as well as the particular battery, OR gate 202 provides the output BL that could be used to indicate "battery low" without necessarily designating which battery is low.

Figure 13A:
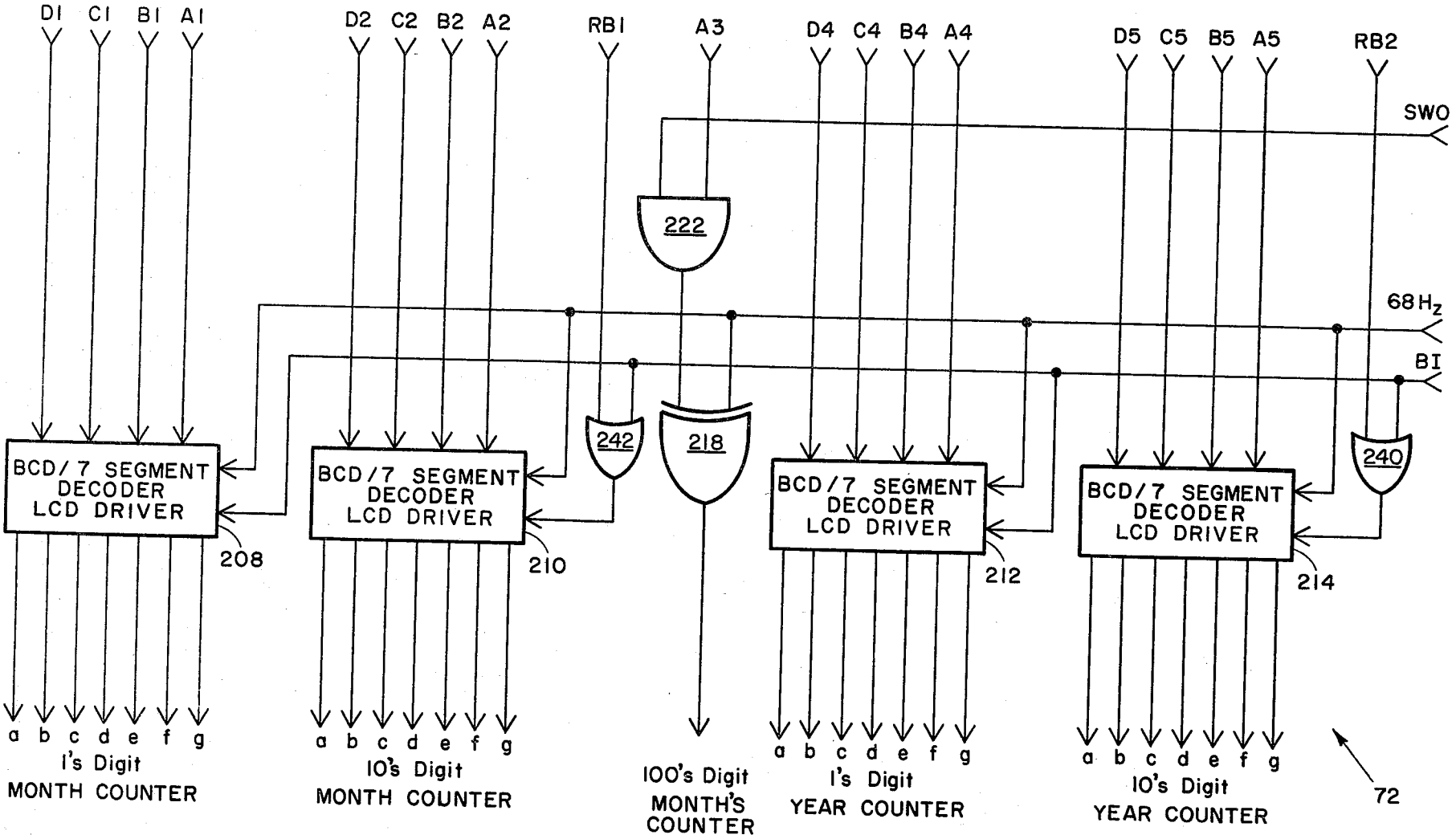
FIGS. 13*a* and 13*b* are schematic diagrams of the LCD driver shown in FIG. 3.
Figure 13B:
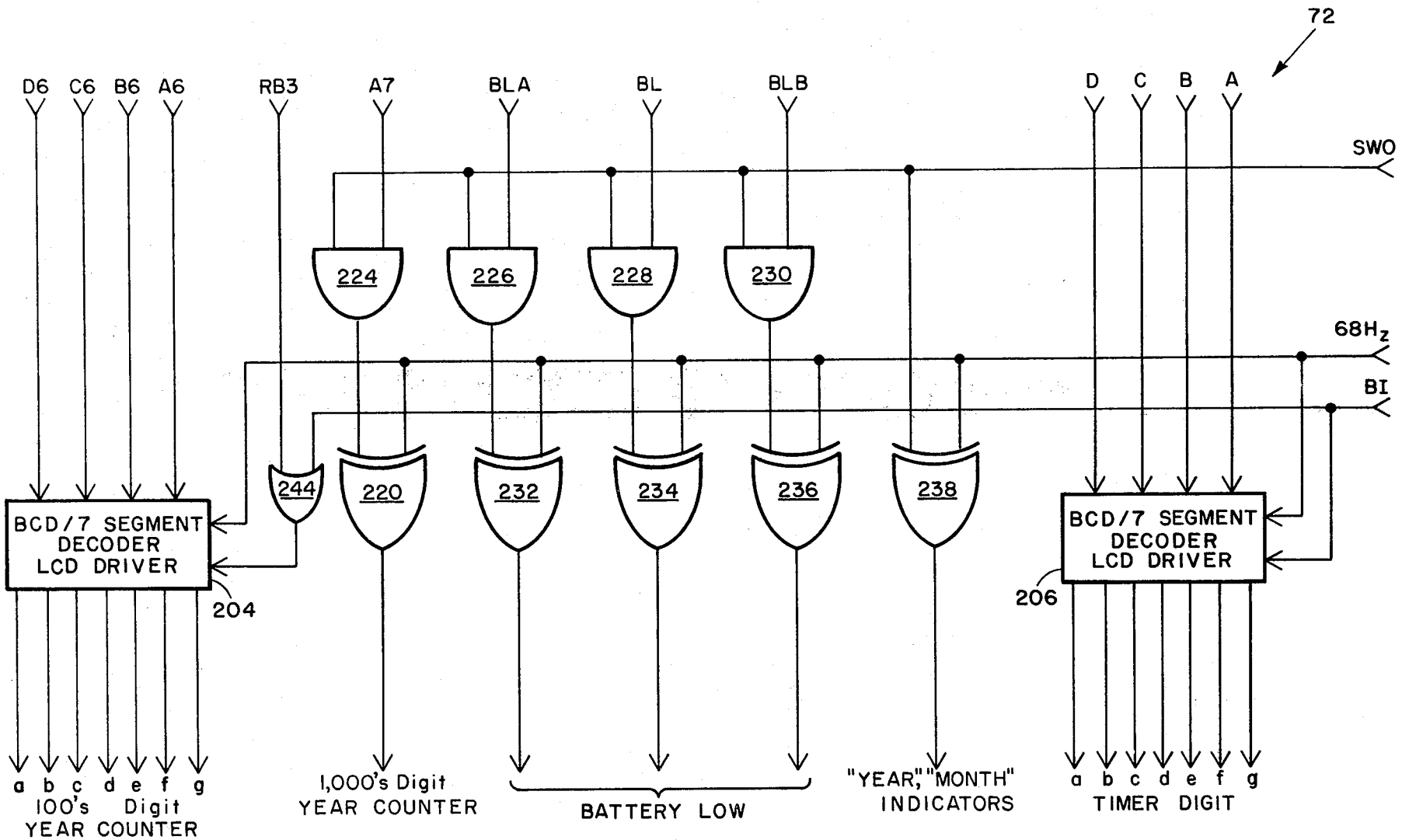

Referring now to FIGS. 13*a* and 13*b* in combination, the LCD driver 72 is shown in detail. The input SWO from switch debounce 62 feeds into LCD driver 72 to start the operation of the LCD driver. Also a 68 Hz signal from the time counter 78 feeds into the LCD driver 72 so that basically all outputs from the LCD driver 72 are AC outputs to the LCD 42. By using alternating voltages to a liquid crystal display, the amount of voltage necessary for operation of a liquid crystal display can be decreased. Also, an input BI is received from the switch debounce 62. In LCD driver 72 there are six BCD/seven segment decoder LCD drivers 204, 206, 208, 210, 212, and 216. The 68 Hz signal which feeds into each of the BCD/seven segment decoder LCD drivers 204, 206, 208, 210, 212, 214 and 216 is used to flash the individual digits ON and OFF. The particular digits being controlled are indicated in FIGS. 13*a* and 13*b*. Also, the 68 Hz feeds through exclusive OR gate 218 to control the hundreds digit or the most significant digit of the month indicator 146. Also, the 68 Hz is fed through exclusive OR gate 220 to control the thousandths digit or the most significant digit of year indicator 48. The operation of the most significant digits through the exclusive OR gates 218 and 220 are controlled by AND gates 222 and 224, respectively. The input SWO from switch debounce 62 also feeds through AND gates 226, 228 and 230, as well as its exclusive OR gates 232, 234 and 236 with the 68 Hz signal to give the battery low indications.

While it was described previously as the month and year indications being engraved on the face of the LCD 42, the month and year could be indicated by month and year indicators shown in FIG. 13*b* through exclusive OR gate 238 that receives the input SWO and the 68 Hz.

Blanking as previously described is provided by the input BI from switch debounce 62 which feeds through OR gate 240 into decoder LCD driver 214, OR gate 242, into decoder LCD driver 210, and OR gate 244 into decoder LCD driver 204.

It should be realized that the liquid crystal display 42 must be specially designed for the presently described invention; however, other off-the-shelf liquid crystal displays could be used without having all of the features of the present invention.

METHOD OF OPERATION

The batteries +A and +B are inserted and the hot water control knob 16 is connected to the shank 28. Upon turning ON the hot water control knob 16, the first count will appear on the LCD 42 at both the month indicator 46 and year indicator 48 indicating a count of 1. After the shower has been ON for three minutes, the green light 34 will begin to flash and there will be an approximately 2 second sonic alarm from sealed speaker 36. After a time lapse of six minutes, if the shower is still ON, the green light 34 will stop flashing and the yellow light 38 will begin to flash. Again, an approximate 2 second sonic alarm will be given by sealed speaker 36. After the expiration of nine minutes, yellow light 38 will stop flashing and red light 40 will begin to flash. Again, an approximately 2 second sonic alarm will be given by sealed speaker 36. Thereafter, as long as the hot water remains ON, the red light 40 will continue to flash.

For subsequent showers, the same procedure will be repeated with the month indicator 46 and year indicator 48 counting upward an additional count. The month indicator can be reset by turning the hot water control knob 16 ON and OFF three times within time intervals of less than 2½ seconds. The year indicator 48 will only be cleared by disconnection of the battery source with the present batteries being designed to last approximately one year.

By use of the system as just described, the individual user of the shower is made conscious of the length of time the shower is ON by both visual and audio indications. Also, a tabulation of the number of showers taken in a particular household is maintained to make the household more conscious of energy conservation through the conserving of hot water within their own home, thus reducing utility bills for home energy consumption.

We claim:

1. A control knob for connection to a shank that rotates to operate a hot water valve, said control knob comprising:
   - housing means;
   - means for removably connecting said housing means to said shank;
   - tilt operable switch means inside said housing means, said switch means being actuated in response to rotation of said shank by said control knob;
   - a source of power connected to said switch means;
   - control circuitry inside said housing operable by said switch means and said source of power;
   - warning means in said control knob and connected to said control circuitry;
   - timing means in said control circuitry so that upon said control knob rotating said shank to turn ON said hot water valve said switch means is actuated to give a signal to said control circuitry which starts said timing means, said timing means having predetermined time intervals for operating said warning means after receipt of said signal to indicate to an individual passage of said predetermined time intervals until said hot water valve is closed thereby deactivating said switch means.

2. The control knob is given in claim 1 wherein said warning means includes a liquid crystal display operated by said control circuitry to indicate minutes the hot water valve has been ON.

3. The control knob as given in claim 2 wherein said control circuitry includes clock means for operating said timing means, progressive counter means operated by said switch means to give progressive counts on said liquid crystal display that corresponds to number of times said hot water valve has been turned ON over long time periods.

4. The control knob as given in claim 3 wherein said progressive counter means includes a month counter and a year counter to indicate number of times said hot water valve is turned ON per month and year, reset means for resetting said month counter and/or year counter.

5. The control knob as given in claim 4 wherein said timing means further includes clock means divided by counter means for giving different clock outputs to logic controls which operate said warning means.

6. The control knob as given in claim 1 wherein said warning means includes visual warning lights and audio device operated by said timing means upon passage of said predetermined time intervals after the hot water valve has been ON.

7. The control knob as given in claim 6 wherein said housing means is divided into a first half and second half sealably connected together to form a chamber therein for receiving said tilt operable switch means, source of power and control circuitry therein; said source of power being batteries.

8. The control knob as given in claim 7 wherein the tilt operable switch means is a mercury switch with an adjustable mounting to control angle of actuation.

9. The control knob as given in claim 1 wherein said source of power is batteries, voltage sensor means monitoring voltage of said batteries to give a warning if the batteries drop below a predetermined level.

10. A control timer for a hot water knob utilized to operate a hot water valve of a shower, said control timer comprising:

battery means inside said hot water knob;

tilt switch means inside said hot water knob and connected to said battery means, said tilt switch means being operated by rotation of said hot water knob;

circuitry means inside said hot water knob connected to both said battery means and said tilt switch means, said circuitry means including:

latch means connected to said tilt switch means to prevent false signals;

clock means for generating clock pulses after receiving a latch signal from said latch means indicating said hot water valve is turned ON;

timing means connected to said latch means and said clock means for giving different output signals as time passes after said hot water valve is turned ON until said hot water valve is turned OFF;

warning means mounted in said hot water knob and connected to said circuitry means and battery means, said warning means being operable by said different output signals of said timing means to give indications to a user of amount of usage of said hot water valve.

11. The control timer as given in claim 10 wherein said warning means includes a liquid crystal display to indicate at least the number of minutes said hot water valve has been ON.

12. The control timer as given in claim 10 wherein said circuitry means further includes a logic portion to generate said different output signal from said timing means and said clock means to drive said warning means.

13. The control timer as given in claims 10, 11 or 12 wherein said warning means includes:

a plurality of different colored lights operated by said different output signals to indicate time said hot water valve has been ON;

a timer to indicate length of time said hot water valve has been ON in minutes from said different output signals;

sonic device to give an audio warning indicating said hot water valve is still ON from said different outlet signals; and counter means operated by said latch means to indicate number of showers taken during given intervals of time.

14. The control timer as given in claim 13 including means for resetting said counter means to zero, said resetting means being connected to said battery means.

15. The control timer as given in claim 13 further including voltage sensor means connected to said battery means and said warning means, said voltage sensor means generating an output to activate said warning means if voltage of said battery means drops below a predetermined voltage.

* * * * *